US006951467B1

(12) United States Patent
Hansen

(10) Patent No.: US 6,951,467 B1
(45) Date of Patent: Oct. 4, 2005

(54) CONDUCTIVE RIVET FOR CIRCUIT CARD

(75) Inventor: David N. Hansen, Sterling Heights, MI (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/890,841

(22) Filed: Jul. 8, 2004

(51) Int. Cl.[7] ..... H01R 12/00
(52) U.S. Cl. ..... 439/82
(58) Field of Search ..... 439/75, 82, 572, 439/573; 361/760

(56) References Cited

U.S. PATENT DOCUMENTS

| | | | | | |
|---|---|---|---|---|---|
| 2,569,059 | A | * | 9/1951 | Huff et al. | 310/249 |
| 3,321,570 | A | * | 5/1967 | Webb | 174/262 |
| 3,548,264 | A | * | 12/1970 | Bainbridge et al. | 361/520 |
| 3,582,978 | A | * | 6/1971 | Petersen et al. | 313/482 |
| 3,710,040 | A | * | 1/1973 | Swinehart | 381/173 |
| 3,766,442 | A | * | 10/1973 | Pearce et al. | 361/520 |
| 4,646,203 | A | * | 2/1987 | Ngo et al. | 361/708 |
| 4,906,198 | A | * | 3/1990 | Cosimano et al. | 439/82 |
| 4,949,450 | A | * | 8/1990 | Scharres | 29/523 |
| 5,115,375 | A | * | 5/1992 | Garay | 361/760 |
| 5,130,882 | A | * | 7/1992 | Hilland | 361/56 |
| 5,131,853 | A | * | 7/1992 | Meyer | 439/82 |
| 5,230,639 | A | * | 7/1993 | Schuppert, Jr. | 439/572 |
| 5,476,350 | A | * | 12/1995 | Kurtz et al. | 411/80.2 |
| 5,656,798 | A | * | 8/1997 | Kubo et al. | 174/265 |
| 5,687,453 | A | * | 11/1997 | Megregian et al. | 16/221 |
| 5,733,133 | A | * | 3/1998 | Matsumura | 439/82 |
| 6,049,039 | A | * | 4/2000 | Fushimi | 174/68.1 |
| 6,084,296 | A | * | 7/2000 | Colello et al. | 257/698 |
| 6,291,780 | B1 | * | 9/2001 | Schleife et al. | 174/267 |
| 6,375,499 | B1 | * | 4/2002 | Lin | 439/573 |

* cited by examiner

*Primary Examiner*—Ross Gushi
(74) *Attorney, Agent, or Firm*—David L. Kuhn; Luis Miguel Acosta; Thomas W. Saur

(57) ABSTRACT

The conductive rivet designed to connect the first and second conducting surfaces of circuit board through an aperture in the board. The rivet includes a conical member with an associated insulating washer associated on one side of circuit board. A T-shaped rivet and cooperating insulating sleeve are designed to contact the opposite side of the circuit board and provide a thermal conduction path via tail on the T-shaped rivet to the conical member on the opposing side.

4 Claims, 1 Drawing Sheet

CONDUCTIVE RIVET FOR CIRCUIT CARD

GOVERNMENT INTEREST

This invention can be made used and licensed by the United Sates for Governmental Purposes without payment to me of any royalty.

BACKGROUND OF THE INVENTION

In one aspect this invention relates to fasteners for attaching items to a substrate. In a further aspect, this invention relates to coated, metallic circuit cards and means to conduct current from one surface coating to the opposite face and not diminish any thermal transfer.

Heat is a particularly destructive condition for circuit card components. In certain applications, particularly in military vehicles and more especially combat vehicles, there is severely limited space for air flow and the vehicles are also subjected to extreme environmental heat under many combat conditions. Failure of a particular card can result in mission failure and death to vehicle users. To combat this problem, the military may use specialized metallic circuit cards that are engineered to enhance heat dissipation. Such cards have insulating layers on each face or surface to isolate the circuit trails from the metallic cards. However, enhanced heat dissipation along the card is of lessened value unless it is possible to further dissipate the heat from the card to the vehicle body in which the card is mounted.

Generally the cards are mounted to a vehicle by means of threaded fasteners or rivets. While such devices are frequently made of metal and provide some heat transfer it is also necessary to electrically insulate the fastener or current feed through from the metallic circuit board substrate in order isolate the electrical circuits on the board's surface.

SUMMARY OF THE INVENTION

The improved rivet structure of the present invention provides improved electrical conductivity between the surfaces of a metallic circuit card while at the same time electrically isolating the rivet from the metallic circuit card substrate. The rivet structure has a conical member formed with an outer annular member. The annular member has a plurality of circumferentially placed projections that extend from the annular member.

A segmented disc is attached to the inner surface of the annular member at the disc's periphery. The segmented disc is formed so the segments project at an angle to a plane defined by the annular member, the free ends of the segments converging near the center of the conical structure so as to define an aperture that is coaxially aligned with the axis of the annular member. By virtue of the angle between the segments and the plane of the annular disc, the free ends of the segments are disposed in and located on a plane spaced from the plane of the annular member on the side of the annular member opposite the circumferentially placed projections. The resulting structure is frusto-conical in shape.

The rivet structure of this invention has an associated insulating washer that is adapted to fit within the volume defined by the frusto-conical structure of the segmented disc. The washer is formed as an annulus of insulating material and has an aperture complimentary to an associated aperture formed in the circuit board to which the rivet structure is to be attached. The outer diameter of the insulating washer is adapted to fit within the inner diameter of the annular member and has a thickness that will not prevent the circumferential projections of the conical structure from contacting the surface of the circuit board.

The insulating rivet of this invention has an insulating sleeve with an outer diameter complimentary to an aperture in the circuit board the insulating sleeve having a head on one end to hold the insulating sleeve in place. The insulating sleeve is inserted in the circuit board so the head also provides an insulating surface on the side of the circuit board opposite the insulating washer. The insulating sleeve in combination with the insulating washer on the opposite side of the circuit board will protect the electrical equipment mounted on the board from short circuits or other electrical drain due to the use of the conductive rivet.

The final element in the conducting rivet of this invention is a tubular T-shaped rivet. The tubular rivet has a head and a leg with a second plurality of circumferentially extending projections extending from the head portion of the tubular rivet. The second plurality of projections extends in the direction of and is coaxially aligned with the leg of the T-shaped rivet. The outer diameter of the T-shaped rivet's leg is complimentary to the inner bore of the insulating sleeve and the aperture defined by the segmented discs so when the T-shaped rivet is inserted among the free end of the segments, they will grip the outer surface of the leg. This securely holds the various parts of the rivet in place with the first and second plurality of projections in contact with the conductive surfaces on the circuit board.

DETAILED DESCRIPTION OF THE PREFERRED EMBODIMENTS

Figure 1:
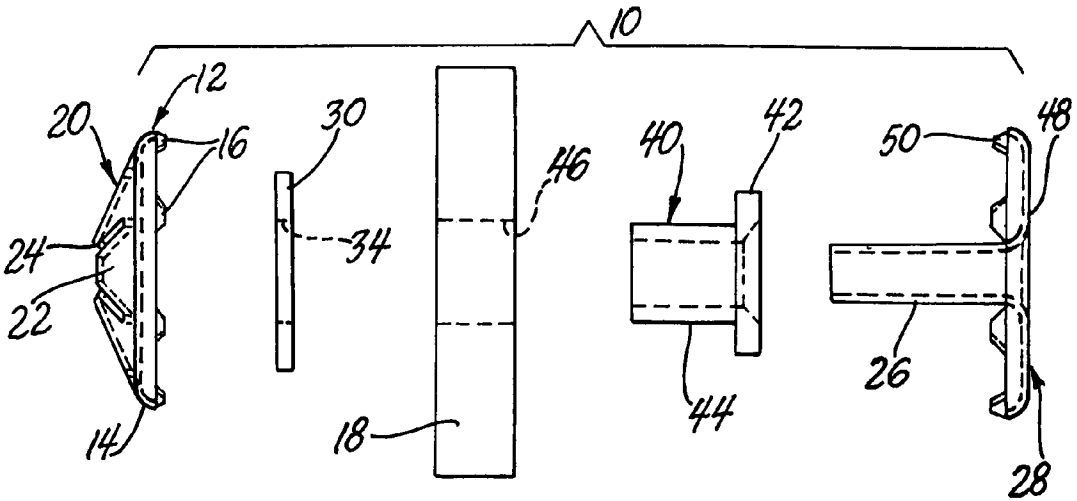
FIG. 1, is an exploded view of one insulating rivet construction according to this invention.

Referring to the accompanying drawing in which like numerals refer to like parts and initially FIG. 1, the rivet structure of this invention 10 has a conical structure designated generally 12 formed with an outer annular member 14. Annular member 14 has a first plurality of projections 16 which are spaced equidistant from each other about the periphery of the conical structure 12. Projections 16 are formed so that they will make good electrical and heat conductivity contact with a conductive surface 17 on circuit board 18 when the conical structure 12 is brought into contact with the conductive surface.

The conical structure 12 has a segmented disc generally 20 formed as shown from a plurality of segments 22, there being six segments in the structure shown. The segments 22 are joined together at their outer diameter to the inner diameter of the annular member 14. The segments 22 project at an angle to a plane defined by the annular member 14, to form frustoconical structure with the free ends 24, of segments 22, defining an aperture at the center of segmented disc 20. The aperture formed by free ends 24 of segments 22 is of a size to allow the free ends to engage a leg 26 of a tubular T-shaped rivet, 28, which will be further discussed hereinafter.

An insulating washer 30, formed of an insulating material, is positioned so as to fit within annular member 12. The insulating washer 30 will be chosen from a suitable class of polymeric insulating materials or otherwise suitable materials which will protect the circuit board surface or prevent unwanted electrical contact with any residual electrically conducting chips, debris, etc. formed when making the aperture in the electrically conductive circuit card 17 from making contact with segments 22. The outer diameter of the washer 30 fits within the inner diameter of annular member 14 and the diameter of aperture 34 is sized to allow leg 26 of the T-shaped rivet 28 to pass through and engage the free ends 22 of segments 24.

The insulating rivet structure 10 of the present invention has an insulating sleeve 40 with a head 42 and tail 44. The tail 44 is chosen to fit snugly within an aperture 46 formed in circuit board 18. The insulating sleeve 40 when inserted into aperture 46 will extend through the circuit board 18 and be held in position the head 42.

A final element in the conducting rivet of this invention is the T-shaped rivet 28 which has a head 48 and a second plurality of circumferentially disposed projections 50 which extend outward from the head 48. The plurality of second projections 50 extend in the direction of and are coaxially aligned with leg 28 of the T-shaped rivet. The outer circumference of leg 28 is complimentary to the inner diameter of insulating sleeve 40 and also complimentary with the aperture formed by the free ends 24 of segmented disc 20.

Figure 2:
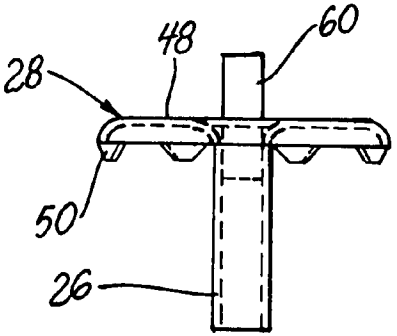
FIG. 2, is a side view, in section, of the rivet of FIG. 1 assembled on a circuit board with the segments fixed into place by expansion of the leg of the rivet.
Figure 3:
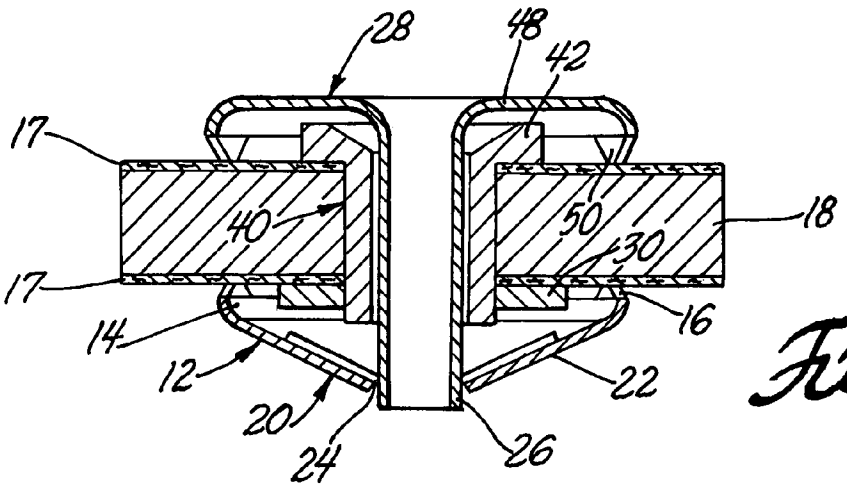
FIG. 3 is a side view of a second embodiment of this invention with a solid stud formed as part of the rivet structure.

Referring to FIG. 2, the conducting rivet structure 10 is assembled by placing the insulating sleeve 40 within aperture 46 of circuit board 18. The insulating washer 30 can be placed over that portion of tail 44 of insulating sleeve 40 that extends beyond the circuit board as shown. This provides a complete insulating structure which slightly overlaps the aperture 46 on both sides of circuit board 18 to protect the conductive surfaces 17 from stray electrical and heat transmission and ensure that the rivet becomes the sole means of heat and electrical conduction between the two surfaces 17. The T-shaped rivet 28 has its leg 26 inserted longitudinally through the bore of insulating sleeve 40 and will extend beyond the tail 44 of the insulating sleeve 42. The conical structure 12 will be placed over that portion of leg 26 which extends beyond the insulating washer with the base of the frustoconical structure being located adjacent surface 18 of the circuit board. As the conical disc is forced downward into contact with the surface 17 of circuit board 18 projections 16 will contact the conductive surface 17 of the circuit board and the free ends 24 of the segments will simultaneously grasp and contact the outer surface of leg 26. The result will be that the projections 16, 50 are firmly in contact and engaging both sides of the circuit board and a sound thermal and electrical connection will be made between the opposed surfaces 17 of the circuit board 18.

As a variation, the T-shaped rivet 28 may have a conductive stud 60 formed as part of the head 48, this variation being disclosed in Figure three. This stud 60 is preferably disposed on the surface of head 48 opposite the second plurality of projections 50. This provides an additional connection to the rivet 10 for heat dissipation. This stud 60 may also be used to attach components or parasitic circuit cards.

Various alterations to this invention will become apparent to those skilled in the art without departing from Scope and spirit of this invention. It is understood that this invention is limited only by the appended claims.

What is claimed is:

1. A conductive fastening structure suitable for connecting first and second conducting surfaces of a circuit board through an aperture in the board comprising:

a conical structure having an annular member with a plurality of circumferentially placed projections extending outward form the annular member, a segmented disc attached at its periphery to the inner surface of the annular member, the segmented disc formed so as to define an aperture coaxially aligned with the axis of the annular member and located on a plane spaced from the plane of the annular member on the side of the annular member opposite the circumferentially placed projections;

an insulating washer adapted to fit within the conical structure the washer having an aperture complimentary to the aperture in the circuit board, and adapted to fit within the circumferential projections of the conical structure;

an insulating sleeve complimentary to the aperture in the board the sleeve having a head on one end to hold the insulating sleeve in place and provide an insulating surface on the side of the circuit board opposite the insulating washer;

a tubular T-shaped rivet having a head and a leg with a second plurality of circumferentially extending projections extending there-from the second plurality of projections extending in the direction and being coaxially aligned with the leg of the T-shaped rivet, the leg of the T-shaped rivet being complimentary to the aperture defined by the segmented disc so as to grip the leg when the leg is forced into the aperture.

2. The conductive fastening structure of claim 1 wherein the head of the tubular rivet further comprises a stud disposed on the surface of the head opposite said second plurality of projections, said stud adapted to provide additional heat dissipation.

3. The conductive fastening structure of claim 1 wherein the head of the tubular rivet further comprises a stud disposed on the surface of the head opposite said second plurality of projections, said stud adapted to provide attachment of parasitic circuit cards.

4. The conductive fastening structure of claim 1 wherein the head of the tubular rivet further comprises a stud disposed on the surface of the head opposite said second plurality of projections, said stud adapted to provide attachment of components.

* * * * *